United States Patent [19]

Solie

[11] 3,967,646

[45] July 6, 1976

[54] THREE-WAY CONTROL VALVE

[75] Inventor: James C. Solie, Owatonna, Minn.

[73] Assignee: Owatonna Tool Company, Owatonna, Minn.

[22] Filed: Aug. 15, 1975

[21] Appl. No.: 605,032

Related U.S. Application Data

[62] Division of Ser. No. 469,424, May 13, 1974, Pat. No. 3,934,610.

[52] U.S. Cl. ..... 137/596.12; 137/596.2

[51] Int. Cl.[2] ..... F15B 13/04; F15B 13/14

[58] Field of Search ..... 137/596.12, 596.2

[56] References Cited

FOREIGN PATENTS OR APPLICATIONS 1,017,793 12/1952 France ..... 137/596.12

*Primary Examiner*—Alan Cohan

*Assistant Examiner*—Gerald A. Michalsky

*Attorney, Agent, or Firm*—Wegner, Stellman, McCord, Wiles & Wood

[57] ABSTRACT

A three-way control valve for a single-acting cylinder or other type of motor in which a valve body has an inlet port, a tank port and a control port, with a pair of poppet-type check valves operable to block flow from the control port to either the inlet port or the tank port. A poppet valve member is operable to control flow between the inlet port and the tank port. Means are provided for operating the poppet valve member and the check valves to cause either advance, return or hold operations of the cylinder and with decompression means for bleeding-off the cylinder pressure prior to opening of one of the check valves to connect the control port to the tank port to reduce the amount of force required to open the latter check valve.

4 Claims, 5 Drawing Figures

THREE-WAY CONTROL VALVE

This is a division of application Ser. No. 469,424, filed May 13, 1974, now U.S. Pat. No. 3,934,610.

BACKGROUND OF THE INVENTION

This invention pertains to a three-way control valve which can be solenoid pilot-operated and with the valve members of the valve being constructed to require low force in operation thereof and with the valve members being of the poppet type to hold pressure in an operating cylinder over a long period of time without leakage.

Many types of control valves are known in the art, including the use of poppet valves and spool-type valves; however, spool-type valves are subject to leakage and can not provide for holding of pressure over a prolonged period of time and prior constructions including use of poppet-type valves have not been economically constructed and arranged for simple operation, as disclosed herein.

SUMMARY

A primary feature of the invention disclosed herein is to provide a three-way control valve having a valve body with an inlet port, a tank port and a control port, a pair of poppet-type check valves acting to prevent flow from the control port to either the inlet port or the tank port, a poppet valve member for controlling flow between the inlet port and a tank port, and means either manually or pilot-operated for controlling the position of the poppet valve member and the action of the poppet-type check valves to operate a cylinder or other motor in advance, return and hold operations.

Another feature of the invention is to provide a three-way control valve wherein the poppet valve member controlling flow between the inlet port and the tank port is balanced whereby a relatively small pilot force is required to operate the poppet valve member.

Another feature of the invention is to provide a three-way control valve wherein the poppet valve member may be pressure-sensitive for manual operation thereof by slight unbalancing of the poppet valve member.

An additional feature of the invention is to provide such a valve wherein one of the poppet-type check valves has decompression means associated therewith whereby pressure existing at the control port can be reduced prior to opening of the check valve to reduce the force required to open this check valve.

DESCRIPTION OF THE PREFERRED EMBODIMENTS

Figure 1:
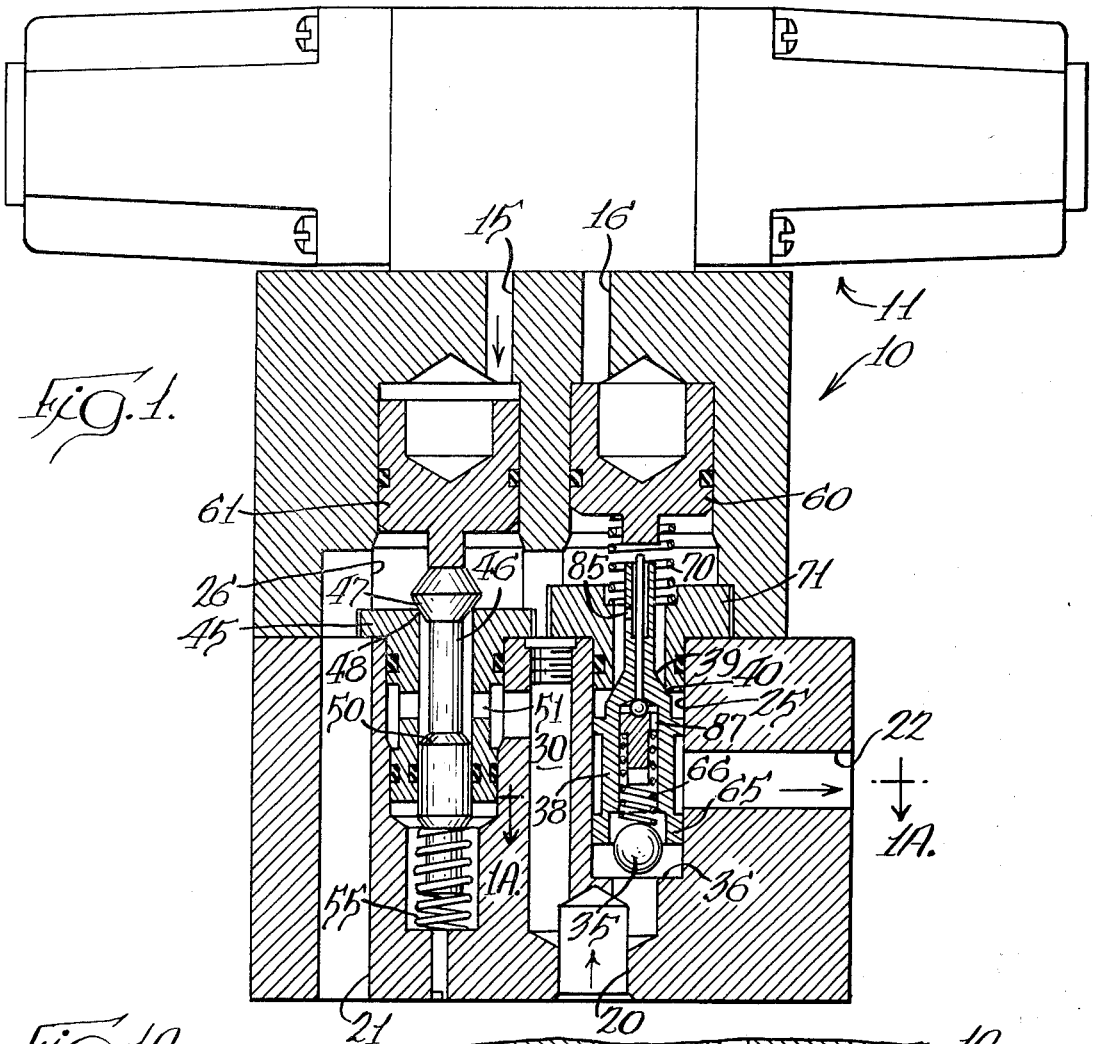
FIG. 1 is an elevational view of the three-way control valve with solenoid pilot operation and with parts of the valve shown in central vertical section and positioned for advance operation.

The three-way control valve as shown in FIG. 1 has a body, indicated generally at 10, with a pilot section, indicated generally at 11, which, as well known in the art, includes a pair of oppositely-acting solenoids controlling a pilot valve (not shown) for selectively controlling the application of pilot fluid to either of a pair of passages 15 and 16 in the valve body 10.

The valve body is provided with an inlet port 20, a tank port 21, and a control port 22. The inlet port 20 is connected to a source of fluid under pressure, such as a pump, with the inlet port communicating with a first bore 25 and a second bore 26. The first bore 25 connects the inlet port 20 and the control port 22 and also connects the control port 22 with the tank port 21 by the open communication across the top of the first bore 25 and the second bore 26. The inlet port 20 communicates with the second bore 26 through a passage 30.

The first bore 25 has a first poppet check valve, in the form of a ball 35, which coacts with a valve seat 36 to block flow from the control port 22 to inlet port 20 when closed and, when open, permits flow of fluid under pressure from the inlet port 20 to the control port 22. A second poppet-type check valve has a valve member 38 with a frusto-conical section 39 forming a poppet-type closure, with a valve seat 40 and with the latter valve functioning to block flow from the control port 22 to the tank port 21.

The second bore 26 mounts a sleeve 45 in which a poppet valve member 46 is movable and with a frusto-conical section 47 engageable with a valve seat 48 on the sleeve. As shown in FIG. 1, the poppet valve member 46 is balanced with a similar frusto-conical section 50 acting in opposition to the frusto-conical section 48 whereby when pressure fluid is delivered to the interior of the sleeve through a passage 51 the forces acting on the poppet valve member are substantially equal and opposite. A spring 55 engages the underside of the poppet valve member, as viewed in FIG. 1, to urge the poppet valve member upwardly from the closed position, shown in FIG. 1.

A pair of solenoid pilot pressure-operated plungers 60 and 61 are positioned within the bores of the valve body and are moved downwardly in response to the application of fluid pressure to the upper side thereof.

Figure 2:
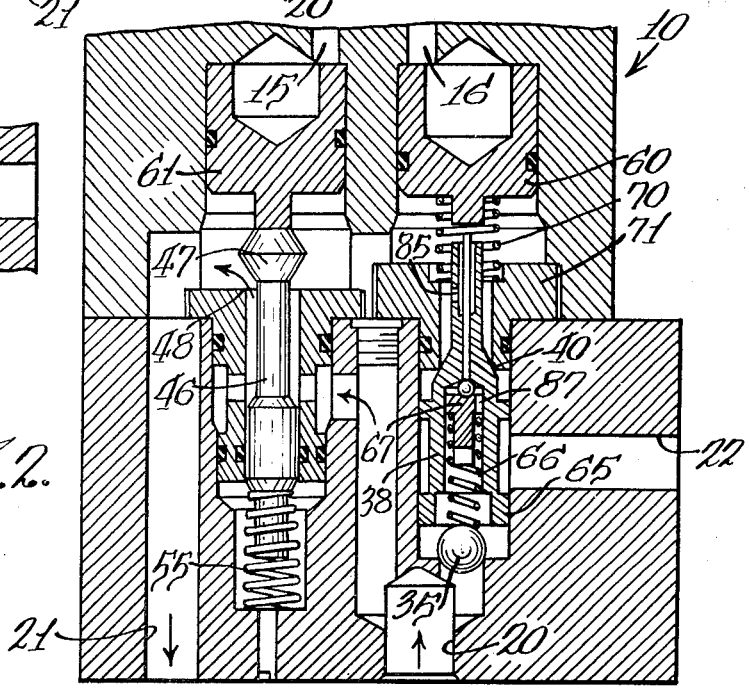
FIG. 2 is a fragmentary view, similar to part of FIG. 1 and with the components positioned for hold operation.

Referring particularly to FIG. 2, which shows the valve components positioned in a hold operation, both of the plungers 60 and 61 are in their uppermost position. As a result, the spring 55 acting on the poppet valve member 46 urges the valve member upwardly whereby the valve section 47 is off the valve seat 48 to connect the inlet port 20 with the tank port 21 whereby there is no fluid pressure force acting upwardly against the first poppet valve member 35. In this operation, any pressure existing in a single-acting cylinder or other motor device connected to the outlet control port 22 acts to assist a spring 66 in holding poppet valve member 35 on its seat 36.

Figure 1A:
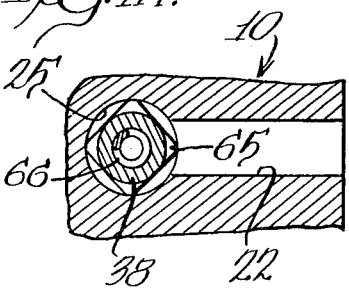
FIG. 1A is a fragmentary plan section, taken generally along the line 1A in FIG. 1.

As seen in FIG. 1A, the bore 25 is generally cylindrical. The body of the valve member 38 is also cylindrical but of a lesser diameter. The valve member has an upper flange and a lower flange which are of a square shape and with the lower flange 65 being shown in FIG. 1A. This permits pressure fluid to act upon the upper side of the spherical poppet ball check 35. Additionally, the spring 66 disposed within the valve member 38 acts on the ball check 35 and also seats against a member 67 positioned within a recess in the valve member 38. This member 67 is part of a decompression means to be described and acts through the valve member 38 which, as shown in FIG. 2, is seated against the valve seat 40 to result in the spring 66 urging the ball check 35 against its seat. There can be no flow from the control port 22 to the tank port 21 in the hold operation, as shown in FIG. 2, because of the second poppet check valve having the valve section 39 thereof seated on the valve seat 40. The internal recess within the valve member 38 is blocked by the decompression means so that there can be no leakage flow through the interior of the valve member 38.

In the hold operation of FIG. 2, the plungers 60 and 61 are held in an upper, inactive position by spring means. A spring 70 engages between the plunger 60 and an insert 71 having the valve seat 40 formed thereon. The spring 55 acts through the poppet valve member 46 to hold the plunger 61 in its uppermost position.

When the control valve is to cause an advance operation, the solenoid-controlled pilot valve directs fluid under pressure through passage 15 against the plunger 61, with the result that the parts are positioned as shown in FIG. 1. As shown therein, the poppet valve member 46 closes against the valve seat 48 to close off communication between the inlet port 20 and the tank port 21. As a result, pressure fluid from the inlet port is applied against the first poppet check valve 35 and, if the pressure applied is higher than that previously existing in the control port 22, the check valve moves away from its seat 36, as shown in FIG. 1. Flow to the control port then occurs by flow past the square flange 65. The first bore 25 is out of communication with the tank port 21 because the second poppet check valve section 39 is closed against its valve seat 40. Upon release of pilot pressure to the plunger 61, the parts return to the hold operation position shown in FIG. 2.

Figure 3:
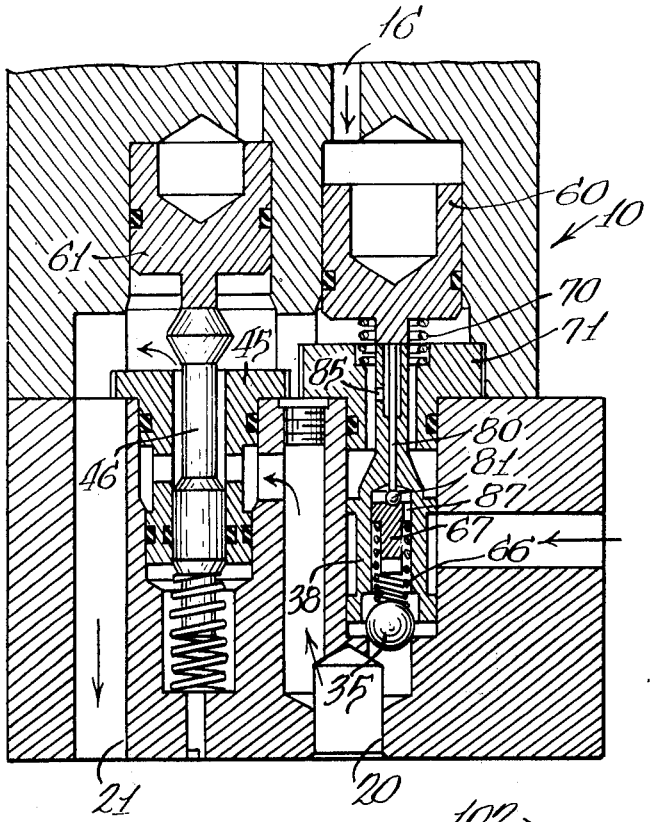
FIG. 3 is a view, similar to FIG. 2, with parts positioned for return operation.

If pilot pressure is applied to the plunger 60 through the passage 16 for a return operation, the parts are then positioned as shown in FIG. 3. The poppet valve member 46 remains in its upper open position with the result that the inlet port 20 is connected to the tank port 21. The movement of the plunger 60 compresses the spring 70, and, during this movement, two successive actions occur. Initially, the lower end of the plunger 60 engages a pin 80 extended lengthwise in the second poppet check valve 38 and which extends outwardly therebeyond, as shown in FIGS. 1 and 2, to lower the pin relative to the check valve and move a small ball check 81 (requiring a small force) away from the lower end of the passage in the poppet valve member which movably mounts the pin 80. The pin 80 is undersized with respect to the diameter of the passage whereby a small amount of fluid can bleed from the control port 22 upwardly through the interior of the valve member 38 past the ball check 81 and through the pin passage to a lateral opening 85 in the valve member 38 with this fluid then flowing to the tank port 21. This reduces the pressure existing at the control port to reduce the total force of fluid pressure acting upwardly against the valve member 38 whereby a smaller force is required to move the valve member 38 to the open position, shown in FIG. 3. Major flow around valve member 38 flows upwardly and through the coils of spring 70 to the tank port 21.

The first poppet check valve 35 is smaller than the bore in the valve member 38 which mounts it to permit flow therepast. A flow passage 87 through the member 67 permits the fluid to reach the ball check 81. As seen in FIG. 3, lowering of the second poppet valve member 38 additionally results in compression of the spring 66 to assist in holding the first poppet valve member 35 on its seat.

Release of fluid pressure from the plunger 60 causes the spring 70 to raise the plunger 60 whereby the first and second check valves as well as the decompression means return to the hold position of FIG. 2.

Figure 4:
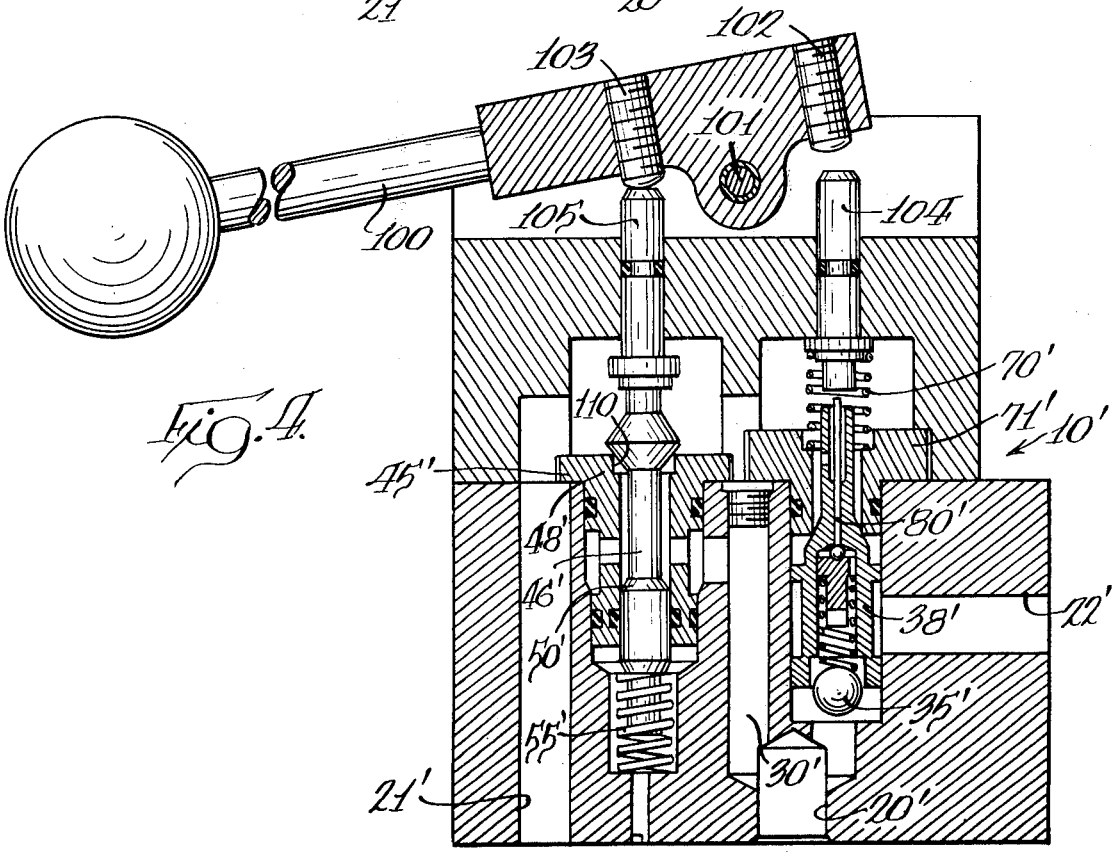
FIG. 4 is a view, similar to FIG. 1, showing an alternate embodiment for manual operation.

An alternate embodiment is shown in FIG. 4 wherein the parts of the same construction as in the embodiment of FIGS. 1–3 have been given the same reference numeral with a prime affixed thereto.

In this embodiment, the solenoid pilot valve unit 11 has been replaced with a manual operator, including a pivoted handle 100 mounted at a pivot 101 to a top part of the valve body and with a pair of adjustable members 102 and 103 for coaction with a pair of plungers 104 and 105, respectively. Plungers 104 and 105 correspond to the plungers 60 and 61, respectively, of the first embodiment. With the handle 100 positioned as shown in FIG. 4, the control valve is positioned for an advance operation similarly as shown in FIG. 1. With the handle 100 disposed horizontally, neither of the plungers 104 or 105 is depressed, which results in a hold operation, as described in connection with FIG. 2 of the first embodiment. When the handle 100 is pivoted to an inclined position, beyond the horizontal and opposite to that shown in FIG. 4, plunger 104 is depressed to obtain a return operation, as shown for the first embodiment in FIG. 3.

In the embodiments of FIGS. 1 to 3, the poppet valve member 46 was balanced with respect to pressure forces applied thereto to minimize the force required to be exerted by the plunger 61. With manual operation, as shown in the embodiment of FIG. 4, it is desirable to have the poppet valve member 46′ pressure-sensitive whereby as the handle 100 is pivoted downwardly toward the position shown in FIG. 4 there is an unbalance of hydraulic forces acting on the valve member to contribute a "feel" to movement of the handle. This action of unbalancing is caused by placing an undercut 110 at the upper end of the insert 45′ whereby the area of the poppet valve section 48 exposed to pressure is greater than the area 50′. This structure also provides a metering action in controlling the rate of flow to the tank port 21′ and, therefore, the rate of advance of a cylinder or other motor connected to the control port 22′.

I claim:

1. A three-way control valve for use with a single-acting cylinder or the like in control of advance, return or hold operation thereof comprising, a valve body having an inlet port, a control port and a tank port, a first bore in said body in communication with all three of said ports, a first poppet check valve in said first bore and having a valve seat whereby, when seated, flow from the control port to the inlet port is blocked, a second poppet check valve in said first bore and having a valve seat whereby, when seated, flow from the control port to the tank port is blocked, a second bore in said body in parallel adjacent relation to said first bore and in communication with said inlet port and the tank port, a spool valve in said second bore with spaced opposed lands and one of said lands defining a poppet valve member coacting with a valve seat to control flow to the tank port, a passage connecting said first bore with said second bore intermediate said spaced opposed lands of said valve spool for fluid flow from the inlet port to the tank port, the poppet valve member in said second bore having an open position to permit flow from the inlet port to the tank port in hold and return operations and to block said flow in an advance operation whereby fluid flows past said first check valve to said control port, means for positioning said poppet valve member, both of said check valves being held on their respective valve seats by fluid pressure in a hold operation, means for opening said second check valve and holding said first check valve closed in a return operation to permit fluid flow from the control port to the tank port, and decompression valve means operable to bleed fluid from the control port to the tank port to reduce said fluid pressure and reduce the force required to open said second check valve, said decompression valve means including a relatively small poppet valve carried by said second check valve, spring means acting between said first check valve and said small poppet valve, a movable pin for opening said small poppet valve, and a movable member for sequentially engaging said pin and said second check valve, said spaced opposed lands of said spool valve being of unequal area with the land defining said poppet valve member being of a greater area to render said valve member pressure-sensitive as moved toward said valve seat for the poppet valve member to initiate said advance operation.

2. A control valve as defined in claim 1 wherein said means for positioning said poppet valve member includes a first movable plunger, said means for opening said second check valve includes a second movable plunger, and a pivoted three-position control handle for manual operation of said plungers with said pressure-sensitive valve member imparting a control feel to said control handle when acting on said first movable plunger.

3. A three-way control valve for use with a single-acting cylinder or the like in control of advance, return or hold operation thereof comprising, a valve body having an inlet port, a control port and a tank port, a first bore in said body in communication with all three of said ports, a first poppet check valve in said first bore and having a valve seat whereby, when seated, flow from the control port to the inlet port is blocked, a second poppet check valve in said first bore and having a valve seat whereby, when seated, flow from the control port to the tank port is blocked, a second bore in said body in parallel adjacent relation to said first bore and in communication with said inlet port and the tank port, a spool valve in said second bore with spaced opposed lands and one of said lands defining a poppet valve member coacting with a valve seat to control flow to the tank port, a passage connecting said first bore with said second bore intermediate said spaced opposed lands of said valve spool for fluid flow from the inlet port to the tank port, the poppet valve member in said second bore having an open position to permit flow from the inlet port to the tank port in hold and return operations and to block said flow in an advance operation whereby fluid flows past said first check valve to said control port, means for positioning said poppet valve member, both of said check valves being held on their respective valve seats by fluid pressure in a hold operation, means for opening said second check valve and holding said first check valve closed in a return operation to permit fluid flow from the control port to the tank port, said first poppet check valve being a ball valve; said second poppet check valve having an elongate body movable in said first bore with a frusto-conical valve section and an internal chamber, and a passage extending therefrom to the end of said elongate check valve body, an open end of said internal chamber being larger than and partially receiving said ball valve for guiding thereof; and decompression means including a ball check positioned within said internal chamber and seated against an end of said passage; a spring guided in said internal chamber and acting against both said ball check and the ball valve, and a pin in said passage for opening said ball check for flow through said passage; a movable member for sequentially engaging said pin and then said elongate body to open the ball check and then the second poppet check valve with such action compressing said spring acting on the ball valve; and a guide land on said elongate body engageable within said first bore and shaped to permit flow therepast from the inlet port to the control port and from the control port to said internal chamber, said spool valve being hydraulically unbalanced to exert a force opposing said poppet valve member positioning means in moving the poppet valve member to said flow-blocking position.

4. A control valve as defined in claim 3 wherein said means for positioning said poppet valve member includes a movable plunger, and a pivoted multi-position control handle for manual operation of said plunger and said movable member with said hydraulically unbalanced spool valve imparting a control feel to said control handle when acting on said movable plunger.

* * * * *